US007825603B2

(12) United States Patent
Pollmann-Retsch

(10) Patent No.: US 7,825,603 B2
(45) Date of Patent: Nov. 2, 2010

(54) LIGHTING ASSEMBLY AND METHOD OF OPERATING A DISCHARGE LAMP

(75) Inventor: Jens Pollmann-Retsch, Aachen (DE)

(73) Assignee: Koninklijke Philips Electronics N.V., Eindhoven (NL)

( * ) Notice: Subject to any disclaimer, the term of this patent is extended or adjusted under 35 U.S.C. 154(b) by 585 days.

(21) Appl. No.: 11/722,807

(22) PCT Filed: Dec. 21, 2005

(86) PCT No.: PCT/IB2005/054369

§ 371 (c)(1),
(2), (4) Date: Jun. 26, 2007

(87) PCT Pub. No.: WO2006/072858

PCT Pub. Date: Jul. 13, 2006

(65) Prior Publication Data

US 2008/0185974 A1 Aug. 7, 2008

(30) Foreign Application Priority Data

Jan. 3, 2005 (EP) ..... 05100004

(51) Int. Cl.
*H05B 32/02* (2006.01)

(52) U.S. Cl. ..... 315/209 R

(58) Field of Classification Search ..... 315/224, 315/307, 209 R

See application file for complete search history.

(56) References Cited

U.S. PATENT DOCUMENTS 5,109,181 A 4/1992 Fischer et al.
5,627,430 A 5/1997 Kira et al.
6,218,025 B1 * 4/2001 Fromm et al. ..... 428/544
6,218,780 B1 * 4/2001 Ehrlichmann et al. ..... 313/631
6,724,147 B2 * 4/2004 Moench et al. ..... 315/82
2002/0047621 A1 4/2002 Van Den Nieuwenhuizer
2002/0125834 A1 * 9/2002 Shoji et al. ..... 315/224
2002/0135324 A1 9/2002 Fujii et al.
2004/0090184 A1 * 5/2004 Arimoto et al. ..... 315/59
2004/0251852 A1 * 12/2004 Kambara et al. ..... 315/291

FOREIGN PATENT DOCUMENTS

EP 0715487 A2 6/1996

(Continued)

*Primary Examiner*—Douglas W Owens
*Assistant Examiner*—Minh D A

(57) ABSTRACT

A lighting assembly, a driver circuit, and a method of operating a discharge lamp are described. A discharge lamp (10) comprises a discharge vessel (14) with at least two electrodes (16) arranged at a distance d for generating an arc between the electrode (16). Driver electronics (32) operate the lamp (10) with electrical power. In order to reduce electrode burn-back, the driver electronics operate the lamp according to a switch-off sequence, which includes a power ramp interval (24) where the lamp (10) is operated with increasing electrical power over time, and subsequently the lamp (10) is switched-off. Also, the driver electronics (32) operate the lamp according to a turn-on sequence upon turning on the lamp (10) with a first turn-on interval (20), where the lamp is operated with electrical power increasing up to an initial maximum power value, and a power ramp interval (22) during which the lamp is operated with electrical power increasing over time from the initial maximum power value to nominal power $P_N$. The initial maximum power value is less than the nominal power value of the lamp.

16 Claims, 4 Drawing Sheets

FOREIGN PATENT DOCUMENTS

| | | | |
|---|---|---|---|
| EP | 0756312 | A2 | 1/1997 |
| EP | 1408723 | A2 | 4/2004 |
| JP | 09069356 | A | 3/1997 |
| JP | 2000106131 | A | 4/2000 |
| JP | 2001283782 | A | 10/2001 |
| WO | 2004089044 | A2 | 10/2004 |
| WO | 2004008482 | A2 | 11/2004 |
| WO | 2004100211 | A1 | 11/2004 |

* cited by examiner

LIGHTING ASSEMBLY AND METHOD OF OPERATING A DISCHARGE LAMP

The invention relates to a lighting assembly comprising a discharge lamp, a driver circuit and to a method of operating a discharge lamp.

A wide variety of discharge lamps is known, which comprise a discharge vessel with at least two electrodes arranged at a distance. In these lamps, an arc is generated between these electrodes.

The invention especially relates to HID (high intensity discharge) lamps. Known types of HID lamps have different fillings in the discharge vessel, with constituents selected e.g. from mercury (Hg), a noble gas, especially Xenon (Xe), and metal halides. Known lamp types further differ by their geometry, especially the distance between the electrodes. Here, short-arc lamps have an electrode distance of less than 2.5 mm.

Short-arc lamps with high power density include UHP (ultra high performance) and CPL (compact power light) lamps. U.S. Pat. No. 5,109,181 describes a high-pressure mercury vapor discharge lamps of this type. The electrodes are made of tungsten. The filling in the discharge vessel comprises mercury in such a quantity that the operating pressure is above 200 bar. This type of lamp operates at a nominal power of 30-50 W. Today, UHP lamps of corresponding type are available with a nominal power of up to 300 W.

A problem associated with discharge lamps in general, and due to increased power density especially with short-arc HID lamps, in particular UHP and CPL lamps, is electrode burn-back. During operation of the lamps, the electrode distance increases. Especially in applications where a point light source is required, like projection applications, this leads to loss of light flux. Thus, electrode burn-back is responsible for losses in maintenance of discharge lamps.

Numerous attempts have been made to reduce electrode bum-back, including electrode cooling and careful selection of electrode material.

It is the object of the present invention to provide a lighting assembly including a discharge lamp, a driver circuit, and a method of operating such a discharge lamp where electrode bum-back is reduced.

This object is solved according to the invention on one hand by a lighting assembly according to claim 1, a driver circuit according to claim 12, and a method of operating a discharge lamp according to claim 15 (switch-off sequence). On the other hand, the object is solved by a lighting assembly according to claim 8, a driver circuit according to claim 13, and a method of operating a discharge lamp according to claim 16 (turn-on sequence), as well as by combination of the two. Dependent claims refer to preferred embodiments.

The invention is based on the discovery of a surprising effect. The inventor has observed that discharge lamps which are operated with a power ramp, i. e. where in a time interval the lamp is operated with its electrical power increasing over time, the electrode distance decreases. This surprising effect may be utilized to limit electrode bum-back by operating a discharge lamp according to special sequences.

According to a first solution of the above given object, driving means are provided for operating the discharge lamp with electrical power. These driving means correspond to an electrical driver circuit which controls current, voltage and/or electrical power supplied to the discharge lamp. The lamp may be connected to the driver circuit at a lamp terminal.

According to the invention, the driving means are operated such that before switching off the lamp, it is operated according to a switch-off sequence. This switch-off sequence includes a power ramp interval, i. e. a time interval where the lamp is operated with increasing electrical power over time. While the term "ramp" is used here, this is not intended to limit the actual shape of the power curve over time. Generally, it is only required for this power curve to be increasing from a lower value at the start of the power ramp interval to a higher value at the end of it. Within the interval, it is preferred for the ramp to be monotonically increasing. In a preferred embodiment, the power ramp is indeed at least substantially linear.

Due to the surprising effect discovered, operation of the lamp with increasing electrical power over time during the power ramp interval will lead to a decreasing electrode distance. This effect is preserved if the lamp is switched off after the power ramp interval. While it may be possible to operate the lamp further at the increased power value reached at the end of the power ramp interval, it is preferred to switch-off the lamp directly after the power ramp interval.

The assembly and method according to the invention help to effectively limit, and even reverse, electrode bum-back. The method may easily be implemented in already existing driver circuits for discharge lamps.

As experiments have shown, the desired effect of reducing electrode distance by using a power ramp can be achieved by a wide variety of different implementations. The power ramp interval may have a duration in the range of 5 s to 30 min. Preferably, the duration will be 30 s to 15 min, most preferably 1 min to 10 min. Within the power ramp interval, the electrical power may be increased by 0.1% to 50% of the nominal power of the lamp. Preferably, the increase is within 0.2% to 20% of the nominal power. In a most preferred embodiment, the increase is in the range from 1% to 10% of the nominal power. The increase of electrical power per unit time during the power ramp interval may be given in relation to the nominal power of the lamp. The possible range of values is quite broad. The overall increase—regardless of the question if the curve is linear, as preferred, or not—may be in the range of $5*10^{-5}$% to 10% of the nominal power per second. More preferably, the increase is $2*10^{-4}$%/s to 0.7%/s. Most preferred is an increase of $1*10^{-3}$%/s to 0.1%/s. Of course, it has to be ensured that the increased power does not damage the lamp. Thus, corresponding measures, e. g. special cooling, may be needed in some applications.

According to a development of the invention, input means are provided to initiate the switch-off sequence. These may correspond to a lamp switch or "off"-key, which is used by an operator to turn off the assembly. However, upon activation of this input means, the lamp is not instantaneously switched off, but instead the switch-off sequence according to the invention is initiated. Means may be provided to inform the operator that the switch-off sequence was initiated, e. g. an optical display. According to a further development, shutter means may be provided which block light emitted from the discharge lamp. A corresponding shutter is activated after initiation of the switch-off sequence, or during the sequence. This serves to prevent the assembly from further emitting light, so that for the operator the assembly has been switched-off, although —internally—the assembly will still complete the switch-off sequence.

It is possible to provide the driving means with a fixed power ramp, thus specifying the duration of the power ramp interval and the curve of power supplied to the lamp during the interval. Such fixed power ramps may be determined in advance for the lamp type used.

However, according to a further development of the invention, the power ramp interval is not fixed. Instead, during the power ramp interval the electrical power is gradually increased according to a predetermined curve, which is preferably linear with a predetermined inclination. At the same time, the voltage applied to the lamp is measured. Since the voltage is dependent on electrode distance, the voltage will decrease. Increase of the electrical power during the power ramp interval is now continued until the voltage has dropped to a predetermined value, which indicates that a desired electrode distance is reached. The predetermined voltage value may be the nominal voltage for a new lamp, or it may be another, slightly higher voltage value that accounts for the already elapsed total burning hours (lifetime) of the lamp. In this implementation, preferably a maximum duration of the power ramp interval is given, so that after the maximum duration the switch-off sequence is completed, even if the predetermined value could not be reached. The maximum duration may be chosen e.g. in the rage of 5 s to 30 min, preferably from 1 min to 10 min.

As a second solution to the object of the invention, a turn-on sequence is proposed. The driving means operate the lamp in a first turn-on interval with increasing electrical power, but only up to an initial maximum power value. This initial maximum power value is less than the nominal power of the lamp.

Then, during a power ramp interval, the lamp is operated with increasing electrical power over time. The electrical power increases from the initial maximum power value to nominal power. During this power ramp interval, which is initiated at a time where the lamp has reached initial stable operating conditions, the effect of reduction of electrode distance is achieved.

The first turn-on interval may have a duration of 10 s to 15 min. The duration is preferably 30 s to 10 min. Most preferred is a first turn-on interval duration in the range of 1 min to 5 min.

The initial maximum power value may be chosen to be in the range of 50% to 99% of the nominal power of the lamp. Preferably, it is within the range of 60% to 90% of the nominal power, and most preferably 65% to 80%. The duration of the power ramp interval may be 1 s to 1 min, preferably 5 s to 30 s, most preferably, the duration will be 10 s to 15 s. The increase of electrical power per unit time during the power ramp interval may be given in relation to the nominal power of the lamp. The possible range of values is quite broad. The overall increase—regardless of the question if the curve is linear, as preferred, or not—may be $1*10^{-2}$% to 50% of the nominal power per second. More preferably, the increase is 0.3%/s to 8%/s. Most preferred is an increase of 1%/s to 3.5%/s.

Generally, the invention is not limited to a specific type of the lamp. However, the underlying effect may be more or less noticeable in different lamp types. The most preferred lamp types for the assembly and the method according to the invention are HID (high intensity discharge) lamps. The effect will be most noticeable for short-arc lamps, where the electrode distance is less than 3.5 mm, preferably less than 2.5 mm. Especially high-pressure mercury vapor discharge lamps with a Hg operating pressure of greater than 100 bar, preferably above 150 bar, most preferably above 200 bar have shown a significant reduction of electrode distance if driven with power ramps. The effect is most noticeable at high power densities, i. e. nominal electrical power of 250 W or more per mm of arc length, preferably more than 300 W per mm.

In the following, embodiments of the present invention are described with regard to the figures, where FIG. 1 is a side view of a discharge lamp;

Figure 1:
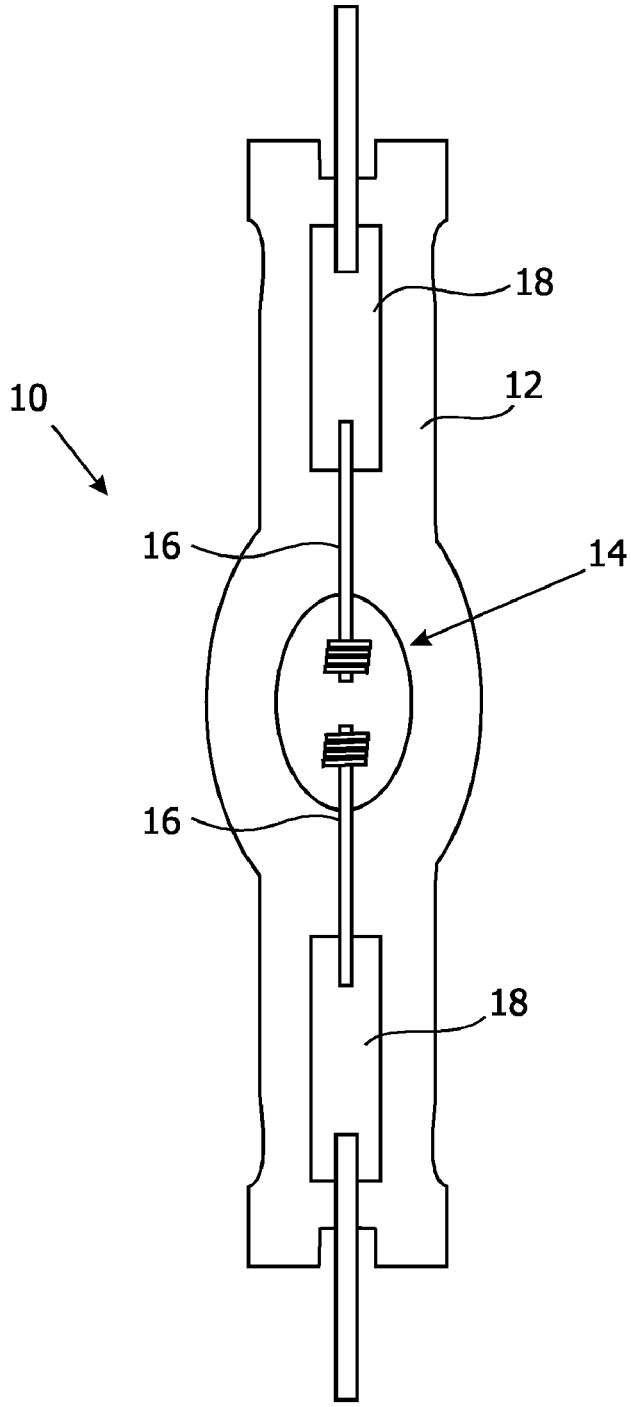
Figure 2:
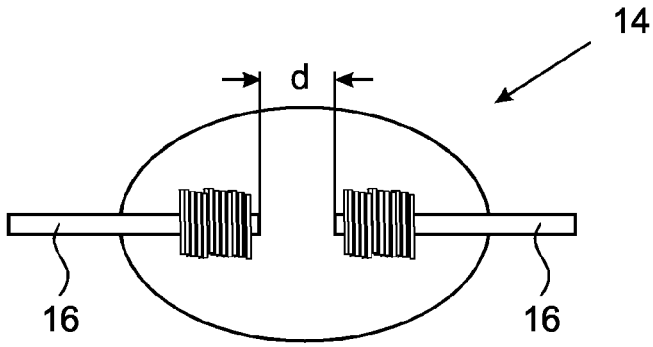
FIG. 2 is an enlarged side view of a discharge vessel from the discharge lamp of FIG. 1.

FIG. 1 shows, as an example of a HID lamp, an UHP lamp 10. A quartz bulb 12 surrounds a discharge vessel 14 of generally rotational symmetric shape. The outer diameter of the bulb is 10.2 mm; the inner diameter is 5 mm. Inside the discharge vessel 14, which is also shown in FIG. 2, electrodes 16 are arranged. Discharge vessel 14 is sealed from the outside. Electrodes 16 are electrically contacted via Mo foils 18 to external connectors.

The electrodes, which are shown in FIG. 2 only as an illustrative example without exact scale, have a diameter of 900 μm. They comprise tungsten rods with coils of tungsten filament around the rods. Each coil comprises 16 inner windings and 14 outer windings, with a filament diameter of 175 μm.

The electrode distance d shown in the example is 1.5 mm.

The filling of discharge vessel 14 comprises 30 mg of mercury, 35 nmol of bromine and 200 mbar of argon. The operating pressure inside discharge vessel 14 is 220 bar.

This configuration leads to electrical properties of lamp 10, where the nominal power is 450 W, with a nominal voltage of 105 V and a nominal current of 4.3 A.

It should be noted that this lamp is presented here only as an example of a lamp, where the surprising effect of decreasing electrode distance during power ramps has been observed. Of course, the lamp design may vary significantly. For example, in a lamp of the above described type the overall size of the discharge vessel may vary with an outer diameter between 9 and 12 mm, and variable inner diameter accordingly. The filling may comprise different amounts of mercury, e. g. 10-48 mg Hg. The diameter of the electrode rod may vary e. g. between 300 and 900 μm, and the electrode distance may vary between 0.7 and 1.8 mm.

For a lamp of the above described type, the electrode distance was examined. During operation of the lamp, images of the electrodes and the arc between the electrodes were recorded, and the electrode distance (arc length) was measured.

Figure 4:
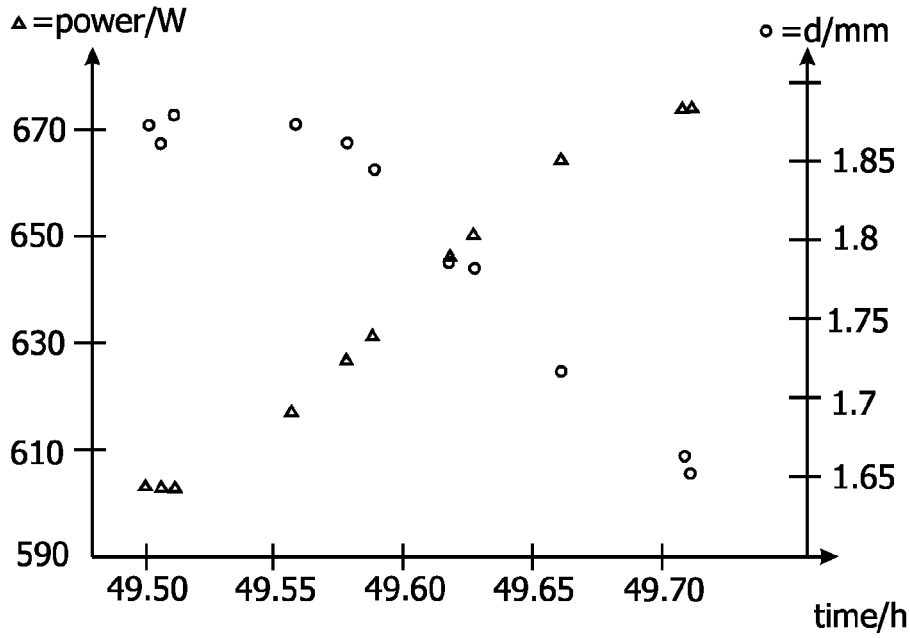
FIG. 4 is a diagram showing the decrease of electrode distance with increasing lamp power.

As can be seen in FIG. 4, the operating power of the lamp was changed after some time of stable operation at 600 W to 675 W during a time interval of 12 min. Images of the electrodes were recorded and electrode distance measured.

As shown in FIG. 4, as the power (shown in triangles) was increased, the electrode distance (shown in circles) decreased significantly. A power increase of about 13% led to a surprising decrease of electrode distance by almost 250 μm, i. e. almost 15%.

This behavior is surprising. Usually, in HID-lamps, especially of the short-arc type, electrode melting or burn-back during high power operation would have been expected, leading to increased electrode distance.

This change in electrode distance, and therefore arc-length, may not only be observed directly, but also indirectly by recording the burning voltage of the lamp.

Figure 5:
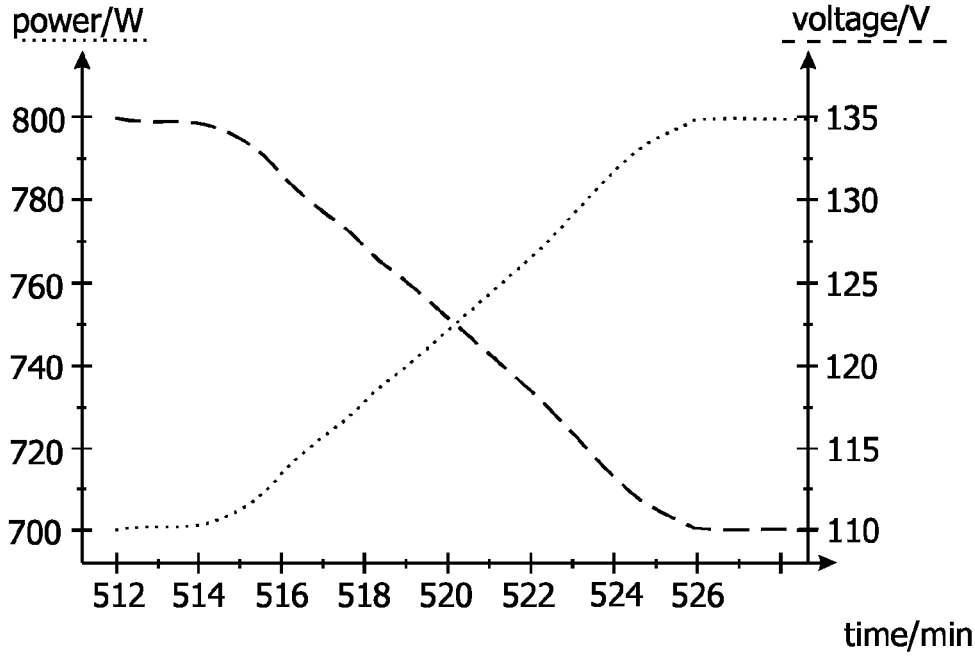
FIG. 5 is a diagram showing a power ramp and corresponding decreasing lamp voltage.

FIG. 5 shows a variation of power for a UHP-type lamp with nominal power of 700 W. In a 15 min time interval the lamp power is increased by 100 W to 800 W. The lamp power in FIG. 5 is shown as a dotted line.

During this time, the lamp voltage, shown in FIG. 5 as a dashed line, dropped from 135 to about 110 Volt (i. e. 19%).

Since it is known, that arc length d and burning voltage of a discharge lamp are dependent on each other, this indicates a decreasing electrode distance.

However, as experiments have shown, the effect is reversible, i. e. a decrease in lamp power over time leads to an increase in electrode distance which corresponds to the decrease observed with an increasing ramp.

Although the power ramps shown in FIG. 4, FIG. 5 were carried out on the scale of minutes, similar effects may be observed on much shorter time scales. As experiments have shown, even changes by about 100 W in only a few seconds led to a behavior of the arc length as described above. A reversal of the power change again yielded a reversal of the change in arc length. The physical reason for the described effect is not clear yet.

In order to put the observed effect to good use, it is proposed to employ power ramps in the operation of discharge lamps, which lead to the observed changes in electrode distance.

As a first proposal, switching on of a discharge lamp may be effected according to a controlled switch-on sequence.

Figure 6:
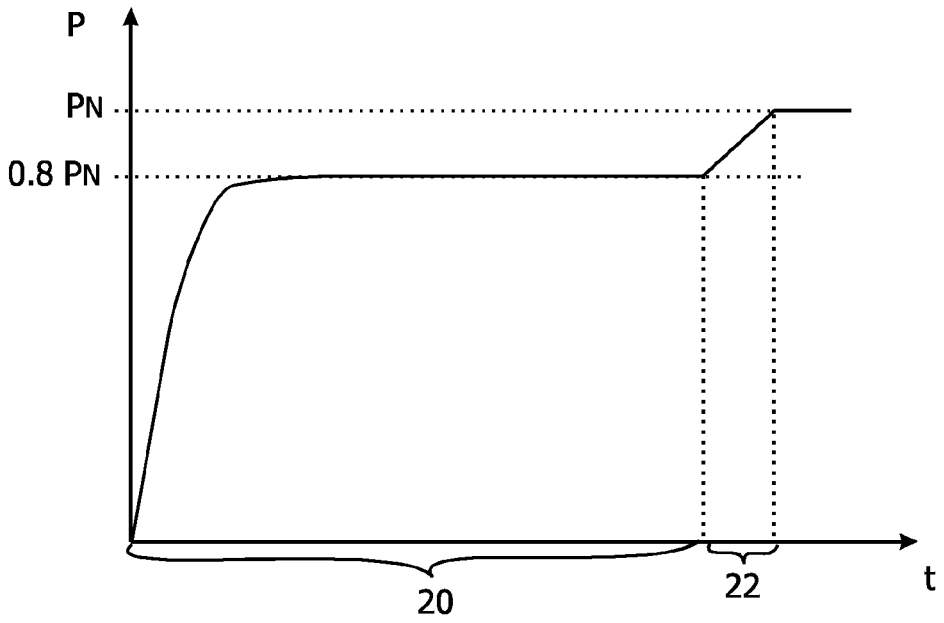
FIG. 6 shows a diagram where electrical power during a turn-on sequence is shown.

FIG. 6 shows in diagram form a proposed switch-on sequence with a curve indicating the variation of electrical power P over time t.

For a discharge lamp with nominal power PN, first the lamp current is limited to a predetermined value, such that the lamp reaches an operating power which is less than the nominal power PN. In the example of FIG. 6, this initial maximum power value corresponds to 80% of nominal power PN. During a time period which will be referred to as first turn-on interval 20, the lamp power is controlled at the initial maximum power value of 0.8 PN. The first turn-on interval lasts until the lamp has reached stable operation. Total duration of interval 20 may therefore be 10 s to 15 min, preferably 1 min to 5 min.

After the first turn-on interval is completed, operation of the lamp is controlled according to a power ramp interval 22, during which the power of the lamp is raised from the initial maximum power value of 0.8 PN in the example to full nominal power PN.

In contrast to an unlimited turn-on current value, which leads to a very quick run-up of the lamp and may cause severe electrode burn-back, the proposed turn-on sequence serves to reduce the burning voltage of the lamp, and therefore the electrode distance.

For example, we consider an UHP lamp with a nominal power of 350 W. After switching on the lamp, the current is limited to 3.2 A until a power of 300 W is reached. The lamp is driven with 300 W for 2.5 to 5 min. After that, the current is no longer limited, and the lamp power is raised within a short time interval of several seconds to the nominal power of 350 W. As experiments has shown, the turn-on sequence as described above reduces burning voltage (and electrode distance) by 5-8% during the power ramp interval 22.

Figure 7:
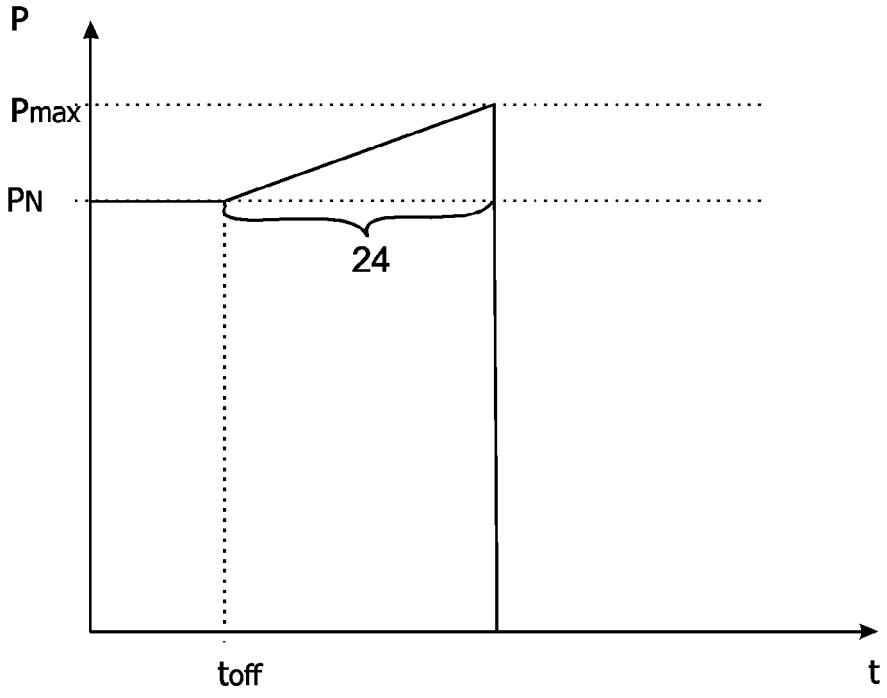
FIG. 7 shows a diagram where electrical power during a switch-off sequence is shown.

FIG. 7 shows a proposed switch-off sequence. Again, power P of a discharge lamp is shown over time t.

After the lamp has been operated at nominal power $P_N$ for some time, a switch-off command is received at a time $t_{off}$. Instead of turning off the lamp immediately, a switch-off sequence is initiated, which includes a power ramp interval 24 and subsequent instantaneous switching off of the lamp. During the power ramp interval 24, the operating power P is increased up to a value $P_{max}$.

Operating the lamp with increasing power over time during power ramp interval 24 leads to a significant decrease in electrode distance, as explained above. Instantaneous switching off of the lamp will conserve the effect, so that upon re-ignition of the lamp after cooling, the reduced electrode distance is preserved.

To give an example of a switch-off sequence, let us consider an UHP lamp with nominal power 700 W and lamp voltage of 109.9V in stable operation. At time $t_{off}$, power ramp interval 24 is started, and power is increased from 700 W to 735 W in 6.5 min. After 6.5 min, the lamp is switched off rapidly. Upon re-ignition of the lamp and operating the lamp at 700 W, the lamp voltage has dropped to 95.7 V, thus indicating a significantly reduced electrode distance.

Instead of using a fixed duration power ramp interval is it possible to continually increase the power until a predetermined voltage threshold is reached. For example, this voltage threshold may be set to the nominal lamp voltage of the new lamp. As over lifetime the lamp voltage increases due to electrode burn back, the power ramp interval 24 of the switch-off sequence is used, and the lamp voltage continuously monitored until it reaches the stored nominal value.

Regarding the power ramps described in connection with FIG. 6, FIG. 7, it should be noted, that the curves shown are linear ramps. While these curves are preferred, other curves may be used to achieve the same effect.

Figure 3:
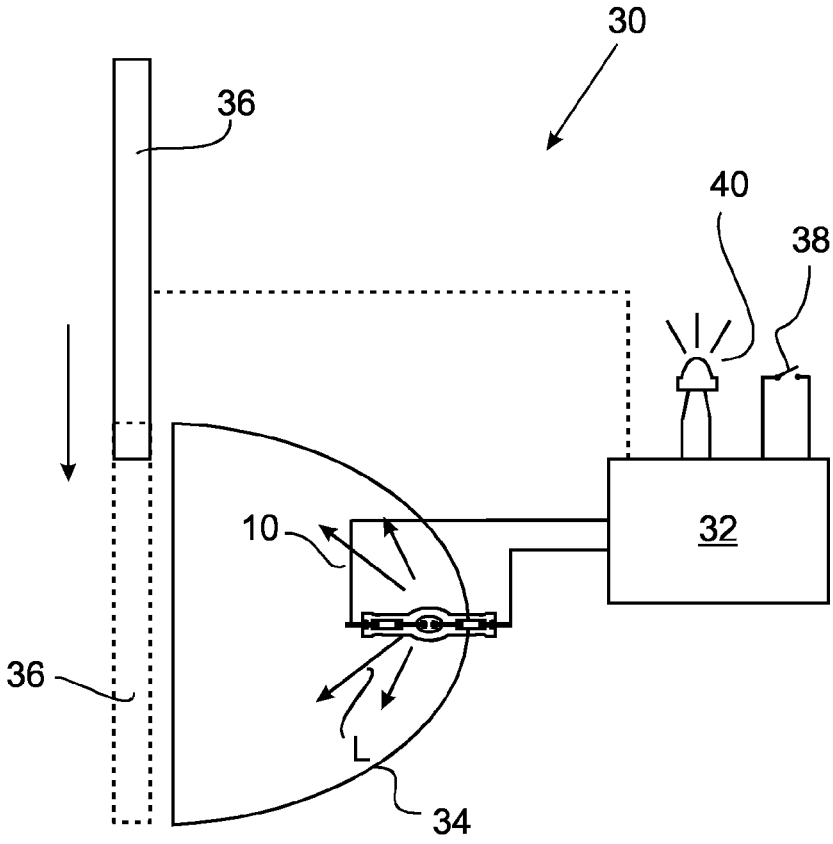
FIG. 3 is a symbolical representation of a lighting assembly.

Finally, FIG. 3 shows a lighting assembly 30. The assembly includes a lamp 10 and a driver circuit 32. Lamp 10 may be part of an optical system, e.g. a projector, whose first component is shown here as a reflector 34. A moveable shutter 36 may be moved within the optical system 34 to block light L emitted from lamp 10. The operation of shutter 36 is also controlled by driver electronics 32. Driver electronics 32 further comprise a "turning-off"-indicator display 40 and a turn-off switch 38.

Assembly 30 incorporates the turn-on-sequence described above in connection with FIG. 6 and the switch-off sequence described above in connection with FIG. 7. As assembly 30 is turned on, driver electronics 32 operate lamp 10 according to the turn-on sequence. After lamp 10 has performed stable operation for some time, the operator decides to switch off the assembly 30 by activating switch 38. Driver electronics 32, instead of immediately turning off lamp 10, operate shutter 36 to block light L emitted from the lamp. Also, indicator light 40 is turned on to inform the operator that the switch-off sequence was initiated. The lamp 10 is then operated according to the switch-off sequence described above either with a fixed duration power ramp interval, or with constant monitoring of the lamp voltage until a predetermined threshold value is reached. After completion of the power ramp interval, lamp 10 is turned off.

The invention claimed is:

1. Method of operating a discharge lamp (10), said discharge lamp (10) comprising a discharge vessel (14) with at least two electrodes (16) arranged at a distance (d) for generating an arc between said electrodes (16), where said lamp (10) is operated according to a switch-off sequence before switching off said lamp, where said switch-off sequence includes a power ramp interval (24), during which said lamp (10) is (i) operated with increasing power over time from a nominal power $P_N$ increased up to a value $P_{max}$, wherein the power ramp interval is configured to reduce the distance, and (ii) instantaneously switched off subsequent to the power ramp interval to preserve the reduced distance.

2. Method according to claim 1, where said power ramp interval (24) has a duration of 5 s to 30 min.

3. Method according to claim 1, where during said power ramp interval (24), said electrical power is increased by 0.01% to 50% of the nominal power $P_N$ of said lamp (10).

4. Method according to claim 1, where during said power ramp interval (24), said increase of electrical power is $5*10^{-5}$% to 10% of a nominal power of said lamp (10) per second of the duration of said power ramp interval (24).

5. Method according to claim 1, where the voltage applied to said lamp (10) is measured, and where during said power ramp interval (24) the electrical power is increased until said voltage reaches a predetermined value, or a predetermined duration or maximum power value is reached.

6. Lighting assembly, including a discharge lamp (10) comprising a discharge vessel (14) with at least two electrodes (16) arranged at a distance (d) for generating an arc between said electrodes (16), and driving means (32) for operating said lamp (10) with electrical power, where said driving means (32) operate said lamp (10) according to a switch-off sequence before switching off said lamp, said switch-off sequence including a power ramp interval (24), where during said power ramp interval (24) said lamp (10) is operated with increasing electrical power over time from a nominal power $P_N$ increased up to a value $P_{max}$, wherein the power ramp interval is configured to reduce the distance, and, after said power ramp interval (24), instantaneous switching off said lamp (10) to preserve the reduced distance.

7. Assembly according to claim 6, said assembly further including input means (38) for initiating said switch-off sequence, where upon activation of said input means (38) said switch-off sequence is initiated.

8. Assembly according to claim 6, said assembly further including shutter means (36) for blocking light emitted from said lamp (10), where said shutter means (36) are activated at the beginning of or during said switch-off sequence.

9. Assembly according to claim 6, where said discharge lamp (10) is a high-pressure mercury vapor discharge lamp, where said discharge vessel (14) comprises mercury at an operating pressure of greater than 100 bar.

10. Assembly according to claim 6, where said distance (d) between said electrodes (16) is less than 3.5 mm.

11. Projection system including a lighting assembly according to claim 6.

12. Method of operating a discharge lamp (10), said discharge lamp (10) comprising a discharge vessel (14) with at least two electrodes (16) arranged at a distance (d) for generating an arc between said electrodes, where said lamp (10) is operated according to a turn-on sequence after turning on said lamp (10), said turn-on sequence including (i) a first turn-on interval (20) where said lamp (10) is operated with electrical power increasing up to an initial maximum power value, where said initial maximum power value is less than a nominal power ($P_N$) of said lamp (10), and where the first turn-on interval has a duration until the lamp has reached stable operation, and (ii) power ramp interval (22), after the first turn-on interval is completed, during which said lamp (10) is operated with electrical power increasing over time from said initial maximum power value to said nominal power ($P_N$), wherein the turn-on sequence of the first turn-on interval and the power ramp interval is configured to reduce the distance.

13. Method according to claim 12, where said initial maximum power value corresponds to 50% to 99% of said nominal power ($P_N$).

14. Lighting assembly, including a discharge lamp (10) comprising a discharge vessel (14) with at least two electrodes (16) arranged at a distance (d) for generating an arc between said electrodes (16), and driving means (32) for operating said lamp (10) with electrical power, where said driving means (32) operate said lamp (10) according to a turn-on sequence after turning on said lamp, said turn-on sequence including (i) a first turn-on interval (20), where said lamp (10) is operated with electrical power increasing up to an initial maximum power value, where said initial maximum power value is less than a nominal power ($P_N$) of said lamp (10), and where the first turn-on interval has a duration until the lamp has reached stable operation, and (ii) power ramp interval (22), after the first turn-on interval is completed, during which said lamp (10) is operated with electrical power increasing over time from said initial maximum power value to said nominal power ($P_N$), wherein the turn-on sequence of the first turn-on interval and the power ramp interval is configured to reduce the distance.

15. Driver circuit for a discharge lamp, including driving means (32) for supplying electrical power to a lamp terminal, where after receiving a switch-off signal said driving means (32) supply electrical power according to a switch-off sequence, said switch-off sequence including a power ramp interval (24), where during said power ramp interval (24) the power supplied at said terminal is increasing over time from a nominal power $P_N$ increased up to a value $P_{max}$, wherein the power ramp interval is configured to reduce a distance for generating an arc between lamp electrode, and, after said power ramp interval (24), electrical power at said terminal is switched off to preserve the reduced the distance.

16. Driver circuit for a discharge lamp, including driving means (32) for supplying electrical power to a lamp terminal, where said driving means (32) when turning on supply electrical power according to a turn-on sequence, said turn-on sequence including (i) first turn-on interval (20), where during said first turn-on interval (20) the electrical power supplied at said terminal is increased up to an initial maximum power value, where said initial maximum power value is less than a nominal power ($P_N$) of said lamp and where the first turn-on interval has a duration until the lamp has reached stable operation, and (ii) a power ramp interval (22), after the first turn-on interval is completed, during which said lamp is operated with electrical power increasing over time from said initial maximum power value to said nominal power ($P_N$) wherein the turn-on sequence of the first turn-on interval and the power ramp interval is configured to reduce a distance for generating an arc between lamp electrode.

* * * * *